US005899005A

United States Patent [19]

Chen et al.

[11] Patent Number: 5,899,005

[45] Date of Patent: May 4, 1999

[54] SYSTEM AND METHOD FOR PREDICTING THE DRYNESS OF CLOTHING ARTICLES

[75] Inventors: Yu-To Chen, Niskayuna; Nicolas Wadih Chbat, Albany; Vivek Venugopal Badami, Schenectady, all of N.Y.

[73] Assignee: General Electric Company, Schenectady, N.Y.

[21] Appl. No.: 09/025,005

[22] Filed: Feb. 17, 1998

Related U.S. Application Data

[62] Division of application No. 08/816,591, Mar. 13, 1997, abandoned.

[51] Int. Cl.[6] ..... F26B 13/10

[52] U.S. Cl. ..... 34/528; 34/535

[58] Field of Search ..... 34/446, 471, 474, 34/475, 476, 488, 499, 491, 493, 528, 535, 595, 606, 607; 318/799, 806; 395/22, 904, 906; 219/497

[56] References Cited

U.S. PATENT DOCUMENTS

| | | | |
|---|---|---|---|
| 5,166,592 | 11/1992 | Bashark | 318/799 |
| 5,172,490 | 12/1992 | Tatsumi et al. | 34/488 |
| 5,315,765 | 5/1994 | Holst et al. | 34/543 X |
| 5,347,727 | 9/1994 | Kim | 34/491 |

OTHER PUBLICATIONS

"Application of Radial Basis Function Neural Network Model for Short–Term Load Forecasting" by DK Ranaweera, et al, IEE Proc.–Gener. Transm. Distrib., vol. 142, No. 1, Jan. 1995, pp. 45–50.

"Orthogonal Least–Squares Learning Algorithm with Local Adaptation Process for Radial Basis Function Networks" by E. Chng, et al., IEE Signal Processing Letters, vol. 3, No. 8, Aug. 1996, pp. 253–255.

*Primary Examiner*—Harold Joyce
*Assistant Examiner*—Steve Gravini
*Attorney, Agent, or Firm*—David C. Goldman; Marvin Snyder

[57] ABSTRACT

The present invention discloses a system and method for predicting the dryness of clothing articles in a clothes dryer 10. In one embodiment of this invention, the clothes dryer 10 uses a temperature sensor 52, a phase angle sensor 54, and a humidity sensor 56 to generate signal representations of the temperature of the clothing articles, the motor phase angle, and the humidity of the heated air in the duct, respectively. A controller 58 receives the signal representations and determines a feature vector. A neural network 168 uses the feature vector to predict a percentage of moisture content and a degree of dryness of the clothing articles in the clothes dryer 10. In another embodiment of this invention, the clothes dryer uses a combination of sensors to predicts a percentage of moisture content and a degree of dryness of the clothing articles.

18 Claims, 12 Drawing Sheets

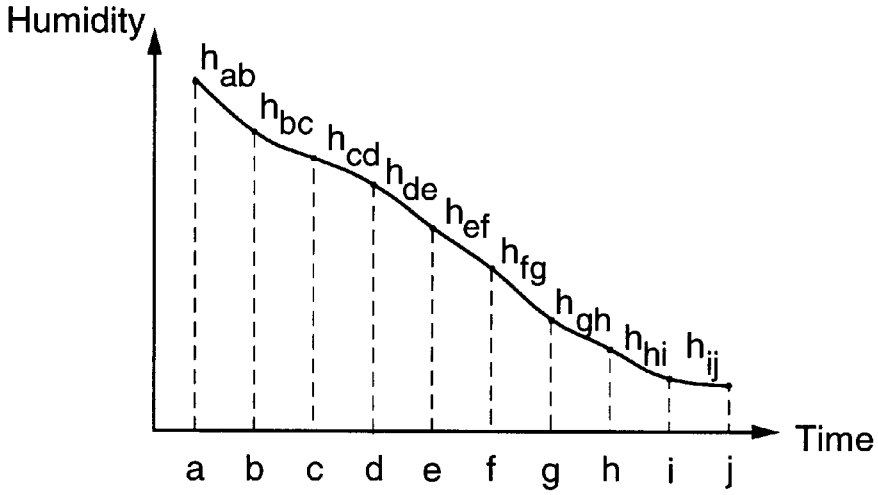

FIG. 8

$$\begin{bmatrix} t_{ab} & T_{ab} & P_{ab} & h_{ab} & w_{ab} & \%MC_{ab} & DoD_{ab} \\ t_{bc} & T_{bc} & P_{bc} & h_{bc} & w_{bc} & \%MC_{bc} & DoD_{bc} \\ t_{cd} & T_{cd} & P_{cd} & h_{cd} & w_{cd} & \%MC_{cd} & DoD_{cd} \\ t_{de} & T_{de} & P_{de} & h_{de} & w_{de} & \%MC_{de} & DoD_{de} \\ t_{ef} & T_{ef} & P_{ef} & h_{ef} & w_{ef} & \%MC_{ef} & DoD_{ef} \\ t_{fg} & T_{fg} & P_{fg} & h_{fg} & w_{fg} & \%MC_{fg} & DoD_{fg} \\ t_{gh} & T_{gh} & P_{gh} & h_{gh} & w_{gh} & \%MC_{gh} & DoD_{gh} \\ t_{hi} & T_{hi} & P_{hi} & h_{hi} & w_{hi} & \%MC_{hi} & DoD_{hi} \\ t_{ij} & T_{ij} & P_{ij} & h_{ij} & w_{ij} & \%MC_{ij} & DoD_{ij} \end{bmatrix}$$

FIG. 9

SYSTEM AND METHOD FOR PREDICTING THE DRYNESS OF CLOTHING ARTICLES

This application is a division of application Ser. No. 08/816,591, filed Mar. 13, 1997 abandoned, which is hereby incorporated by reference in its entirety.

FIELD OF THE INVENTION

The present invention relates generally to an appliance for drying articles, and more particularly to a system and method for predicting the moisture content and degree of dryness of the articles in the appliance.

BACKGROUND OF THE INVENTION

Typically, an appliance for drying articles such as a clothes dryer for drying clothing articles uses an open control loop to dry the articles. The open control loop allows a user to set a drying time for drying the clothing articles. Setting the drying time requires an estimation by the user of when the clothing articles will be dry and generally results in the articles being either over-heated or under-heated. Over-heating of clothing articles results in unnecessary longer drying times, higher energy consumption, and the potential for damaging the articles. On the other hand, under-heating causes great inconvenience because the user has to reset the drying time and wait again for the clothing articles to be dry. Since the drying results provided by the open control loop are unpredictable, further clothes processing such as ironing is hindered. Accordingly, there is a need for a clothes dryer that can predict the moisture content and degree of dryness of the articles in order to facilitate further clothes processing.

SUMMARY OF THE INVENTION

In a first embodiment of this invention there is provided an appliance such as a clothes dryer for drying clothing articles. The dryer comprises a container for receiving the clothing articles. A motor rotates the container about an axis. A heater supplies heated air to the container. A duct directs the heated air outside the container. A temperature sensor senses the temperature of the heated air and provides signal representations thereof. A phase angle sensor senses motor phase angle and provides signal representations thereof. A humidity sensor senses the humidity of the heated air in the duct and provides signal representations thereof. A controller responsive to the temperature sensor, the phase angle sensor, and the humidity sensor predicts a percentage of moisture content and a degree of dryness of the clothing articles in the container as a function of the heated air temperature, the motor phase angle, and the humidity of the heated air.

In a second embodiment of this invention there is provided an appliance such as a clothes dryer for drying clothing articles. The dryer comprises a container for receiving the clothing articles. A motor rotates the container about an axis. A heater supplies heated air to the container. A duct directs the heated air outside the container. A combination of sensors is selected from a group comprising a temperature sensor for sensing the heated air and providing signal representations thereof, a phase angle sensor for sensing the motor phase angle and providing signal representations thereof, or a humidity sensor for sensing the humidity of the heated air entering the duct and providing signal representations thereof. A controller responsive to the combination of selected sensors predicts a percentage of moisture content and a degree of dryness of the clothing articles in the container.

DESCRIPTION OF THE DRAWINGS

FIG. 8 shows an example of a humidity time series plot during data acquisition;

FIG. 9 shows an example of a feature matrix acquired during data acquisition.

DETAILED DESCRIPTION OF THE INVENTION

Figure 1:
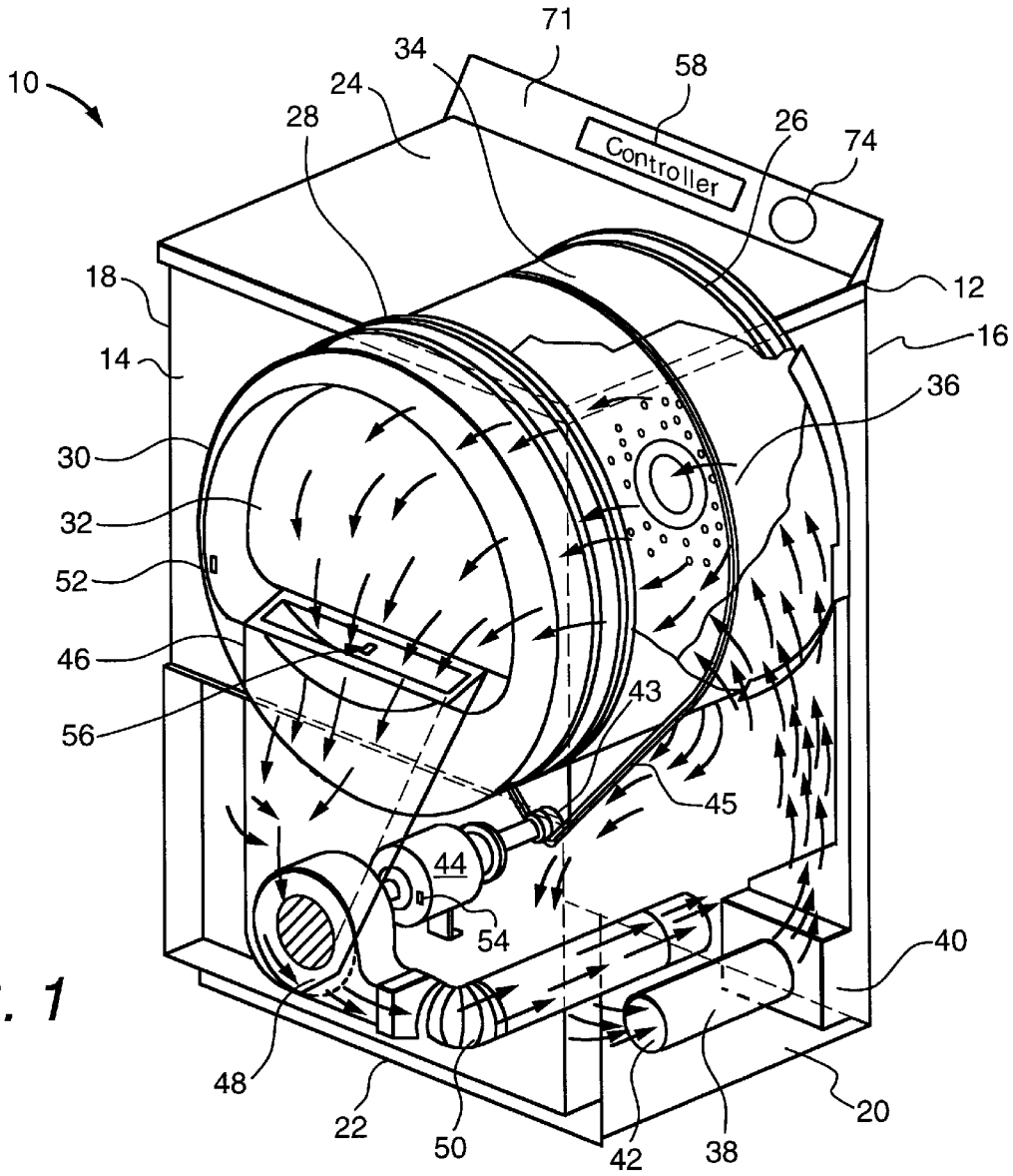
FIG. 1 shows a perspective view of a clothes dryer used in this invention.

FIG. 1 shows a perspective view of a clothes dryer 10 used with this invention. The clothes dryer includes a cabinet or a main housing 12 having a front panel 14, a rear panel 16, a pair of side panels 18 and 20 spaced apart from each other by the front and rear panels, a bottom panel 22, and a top cover 24. Within the housing 12 is a drum or container 26 mounted for rotation around a substantially horizontal axis. A motor 44 rotates the drum 26 about the horizontal axis through a pulley 43 and a belt 45. The drum 26 is generally cylindrical in shape, having an imperforate outer cylindrical wall 28 and a front flange or wall 30 defining an opening 32 to the drum. Clothing articles and other fabrics are loaded into the drum 26 through the opening 32. A plurality of tumbling ribs (not shown) are provided within the drum 26 to lift the articles and then allow them to tumble back to the bottom of the drum as the drum rotates. The drum 26 includes a rear wall 34 rotatably supported within the main housing 12 by a suitable fixed bearing. The rear wall 34 includes a plurality of holes 36 that receive hot air that has been heated by a heater such as a combustion chamber 38 and a rear duct 40. The combustion chamber 38 receives ambient air via an inlet 42. Although the clothes dryer 10 shown in FIG. 1 is a gas driver, it could just as well be an electric dryer without the combustion chamber 38 and the rear duct 40. The heated air is drawn from the drum 26 by a blower fan 48 which is also driven by the motor 44. The air passes through a screen filter 46 which traps any lint particles. As the air passes through the screen filter 46, it enters a trap duct seal 48 and is passed out of the clothes dryer through an exhaust duct 50. After the clothing articles have been dried, they are removed from the drum 26 via the opening 32.

In a first embodiment of this invention, a temperature sensor 52, a phase angle sensor 54, and a humidity sensor 56 are used to predict the percentage of moisture content and degree of dryness of the clothing articles in the container. The temperature sensor 52 senses the temperature of the heated air passing through the screen filter 46 and the phase angle sensor 54 senses the phase angle of the motor 44 as the drum 26 is rotated. As the heated air is drawn from the drum 26 the humidity sensor 56 senses the humidity of the heated air in the duct. The temperature sensor may be a commercially available sensor such as an Omega thermocouple type K, the phase angle sensor 54 may be a general purpose single phase induction motor sensor, and the humidity sensor may be a commercial off-the shelf item such as a Parametrics HT-119. The temperature sensor 52, the phase angle sensor 54, and the humidity sensor 56 provide signal representations of the temperature of the heated air, the phase angle of the blower motor, and the humidity of the heated air in the duct, respectively, to a controller 58. The controller 58 is responsive to the temperature sensor 52, the phase angle sensor 54, and the humidity sensor 56 and predicts a percentage of moisture content and degree of dryness of the clothing articles in the container as a function of the heated air temperature, the motor phase angle, and the humidity of the heated air.

Figure 2:
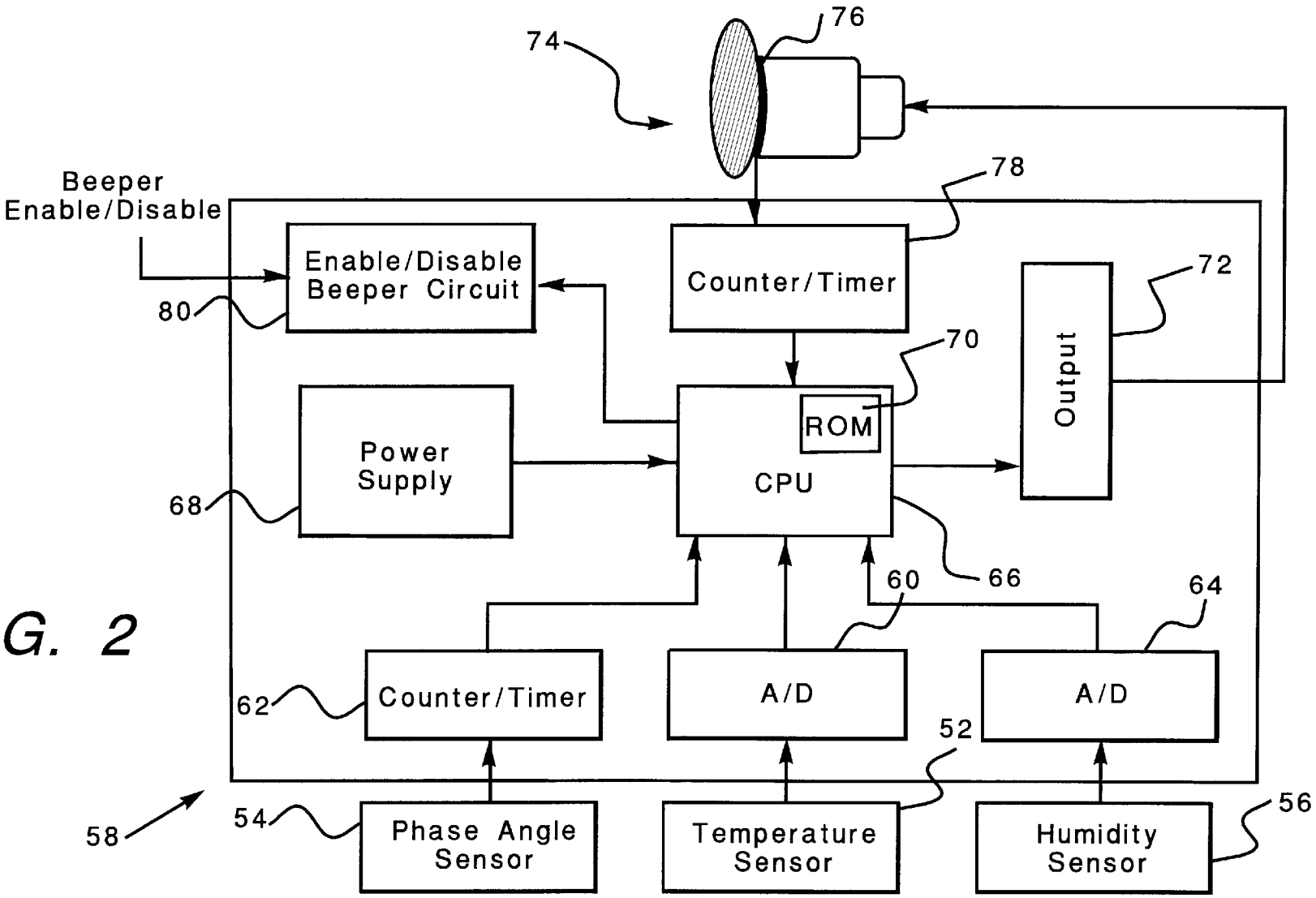
FIG. 2 shows a block diagram of a controller used in this invention.

A more detailed view of the controller 58 used in this embodiment is shown in FIG. 2. The controller comprises an analog to digital (A/D) converter 60 for receiving the signal representations sent from the temperature sensor 52, a counter/timer 62 for receiving the signal representations sent from the phase angle sensor, and an A/D converter 64 for receiving the signal representations sent from the humidity sensor 56. The signal representations from the A/D converters 60 and 64 and the counter/timer 62 are sent to a central processing unit (CPU) 66 for further signal processing which is described below in more detail. It is also within the scope of this invention to use the clock within the CPU 66 for directly receiving the signal representations from the phase angle sensor 54 instead of the counter/timer 62. The CPU which receives power from a power supply 68 comprises a neural network stored in a read only memory (ROM) 70 for predicting a percentage of moisture content and degree of dryness of the clothing articles in the container as a function of the heated air temperature, the motor phase angle, and the humidity of the heated air. The neural network used to predict moisture content and degree of dryness is described below in more detail. Once it has been determined that the clothing articles are dry, then the CPU 66 sends a signal to an output circuit 72 which sends a signal to shut off a cycle selector knob 74 located on a control panel 71 of the dryer 10. The position of the selector knob 74 is monitored by a position encoder 76 which sends signals to a counter/timer 78 which is connected to the CPU 66. As the drying cycle is shut off the controller activates a beeper via an enable/disable and beeper circuit 80 to indicate the end of the cycle.

Figure 3:
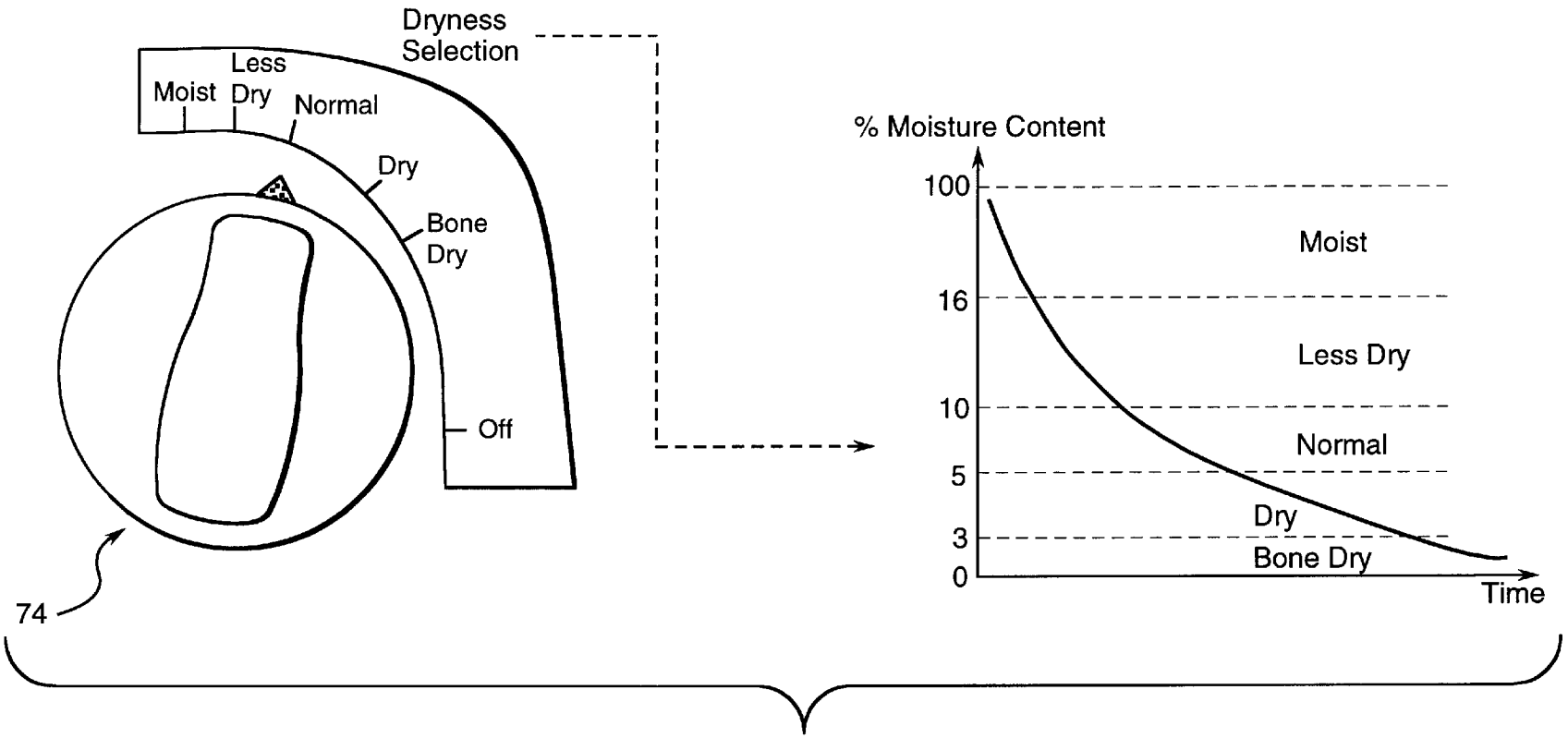
FIG. 3 shows a schematic of the dryness selection used in this invention.
Figure 4:
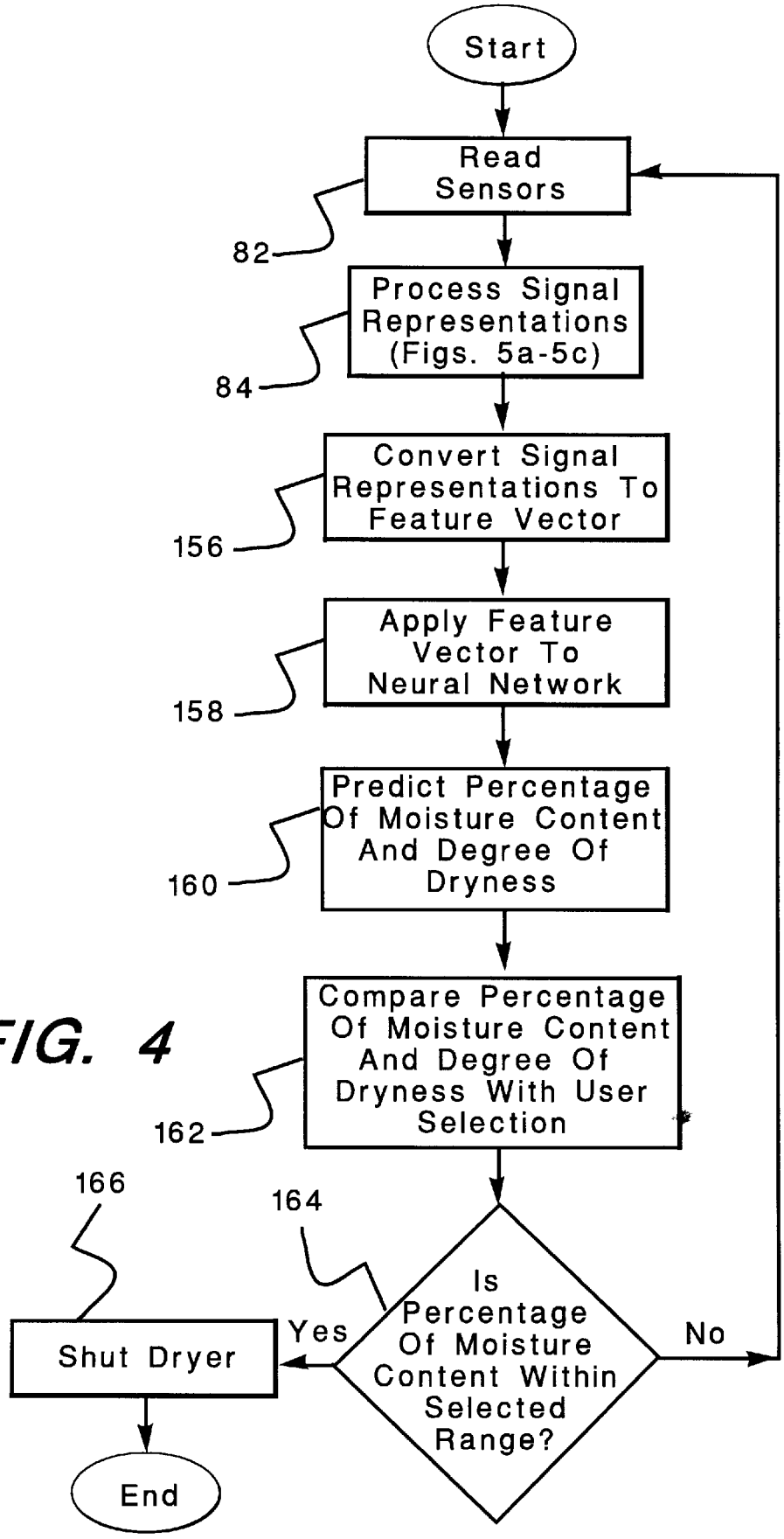
FIG. 4 shows a flow chart setting forth the steps used to determine the percentage of moisture content and degree of dryness used in this invention.

The operation of the clothes dryer 10 is described with reference to FIGS. 3–4. After the clothing articles have been loaded into the drum 26 through the opening 32, the user selects the desired dryness of the articles. FIG. 3 is a schematic of the dryness selection used in the invention. In the illustrative embodiment, the dryness selection comprises five dryness states; i.e., moist, less dry, normal, dry, and bone dry. Other arbitrary dryness selection classifications are within the scope of the invention such as more dry, dry, less dry, and moist. There may be more or fewer dryness selection classifications if desired. Each dryness state selection results in the clothing articles being dried to a particular moisture content. For example, a moist selection results in the clothing articles being dried so that there is a percentage of moisture content ranging from about 100% to about 16% remaining in the articles. A less dry selection results in the clothing articles being dried so that there is a percentage of moisture content ranging from about 16% to about 10% remaining in the articles. A normal selection results in the clothing articles being dried so that there is a percentage of moisture content ranging from about 10% to about 5% remaining in the articles. A dry selection results in the clothing articles being dried so that there is a percentage of moisture content ranging from about 5% to about 3% remaining in the articles. A bone dry selection results in the clothing articles being dried so that there is a percentage of moisture content ranging from about 3% to about 0% remaining in the articles. Since this invention can have many arbitrary dryness selection classifications, it is within the scope of the invention to have arbitrary ranges for the percentage of moisture content that correspond to the dryness selection classifications.

The corresponding dryness selections are illustrated in FIG. 3's plot of remaining moisture content and drying time. As seen in FIG. 3, the remaining moisture content in the clothing articles is high at the beginning of the drying cycle and gradually decreases from moist to the less dry, normal, dry, and bone dry regions as the time of the drying cycle increases; if the clothes dryer is allowed to keep drying during the open loop. In this invention, the user selects the desired dryness by moving the selector knob 74 to a particular setting. For example, if the user selects normal, then the drying cycle continues until the percentage of moisture content remaining in the clothing articles is predicted to be in the range of about 10% to about 5%. Once the percentage of moisture content remaining in the clothing articles is predicted to be in range then the clothes dryer 10 is shut off.

The percentage of moisture content remaining in the clothing articles is determined by the controller 58. FIG. 4 is a flow chart setting forth the steps used by the controller 58 to determine the percentage of moisture content. During the drying cycle the temperature sensor 52, the phase angle sensor 54, and the humidity sensor 56 are read at 82. The signal representations are then processed by the CPU 66 at 84. The signal representations generated from the temperature sensor 52 and the humidity sensor 56 are logged to the CPU 66 at a sampling rate of 1 Hz while the phase angle signal representations are logged to the CPU at a sampling rate of 10 Hz. The CPU 66 has seven buffers A, B, C, D, E, F, and G reserved therein. Buffers A, B, and C are reserved for the phase angle signal representations, buffers D and E are reserved for the temperature signal representations, and buffers F and G are reserved for the humidity signal representations. Buffer A is capable of storing 14 data points, while Buffers B and C are capable of storing 32 and 4 data points, respectively. For the temperature signal processing, Buffer D is capable of storing 16 data points, while Buffer E is capable of storing 4 data points. For the humidity signal processing, Buffer F is capable of storing 16 data points, while Buffer G is capable of storing 4 data points.

Figure 5A:
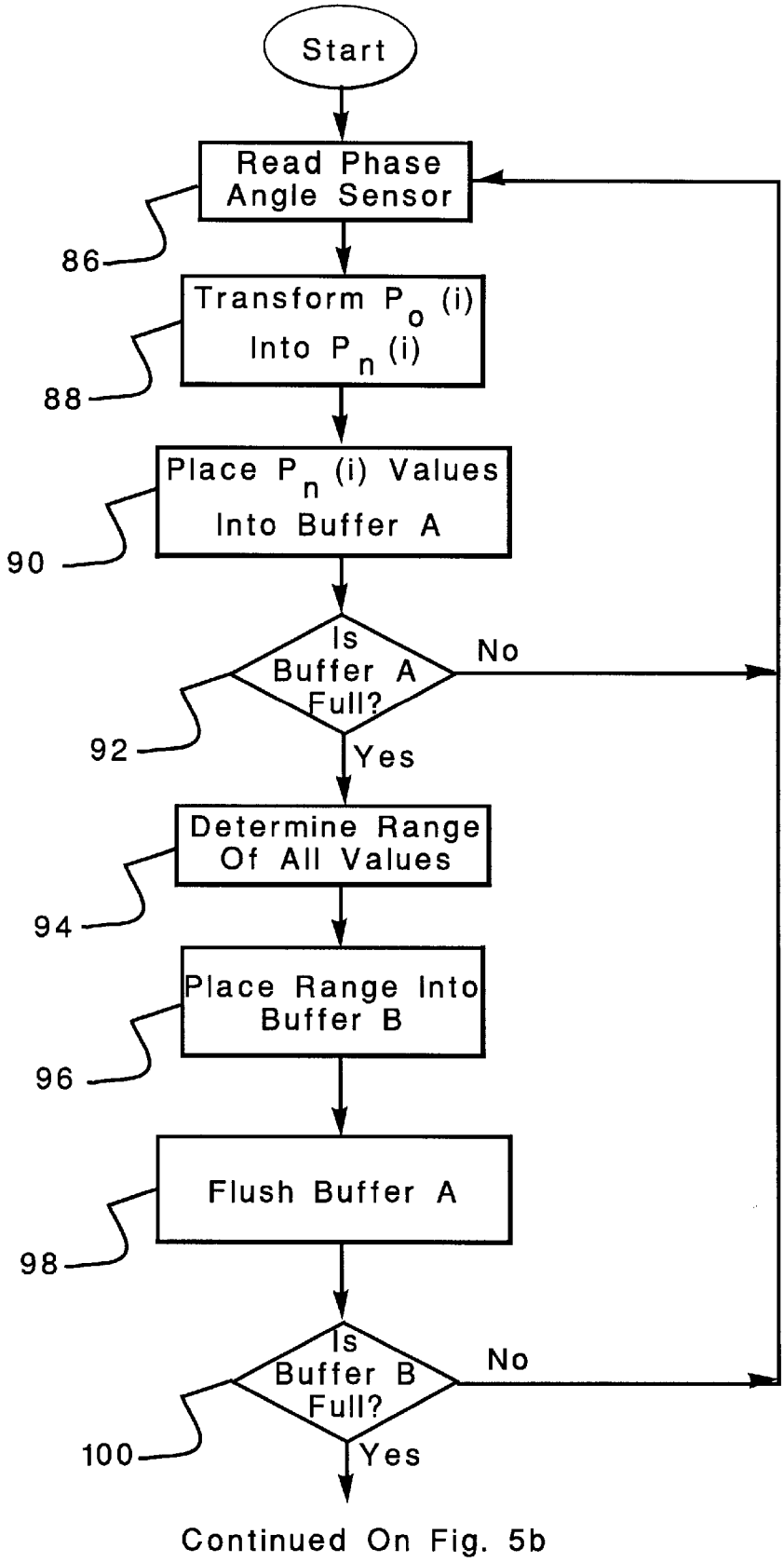
FIGS. 5*a*–5*c* shows a flow chart setting forth the signal processing steps performed in this invention.
Figure 5B:
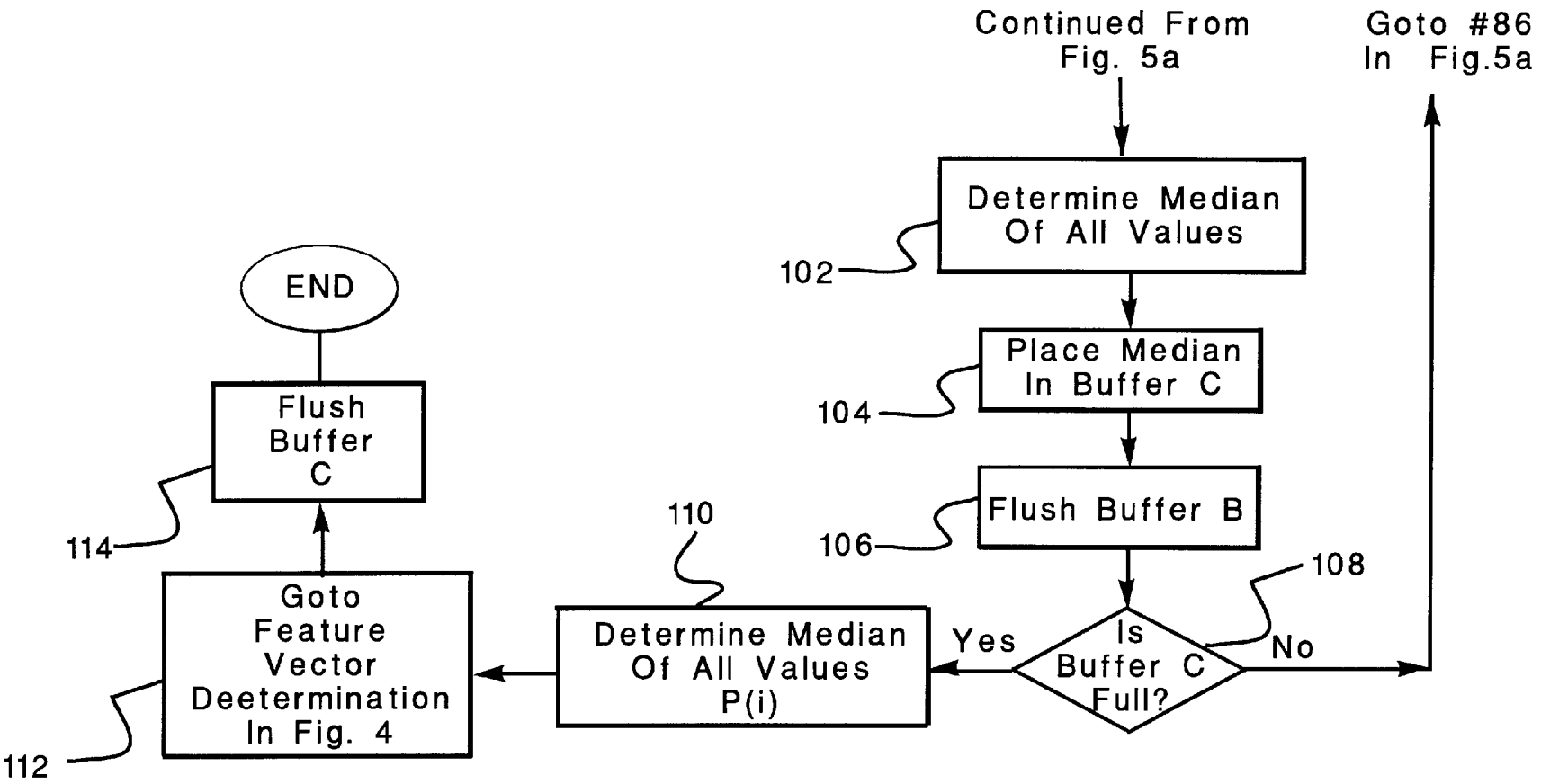
Figure 5C:
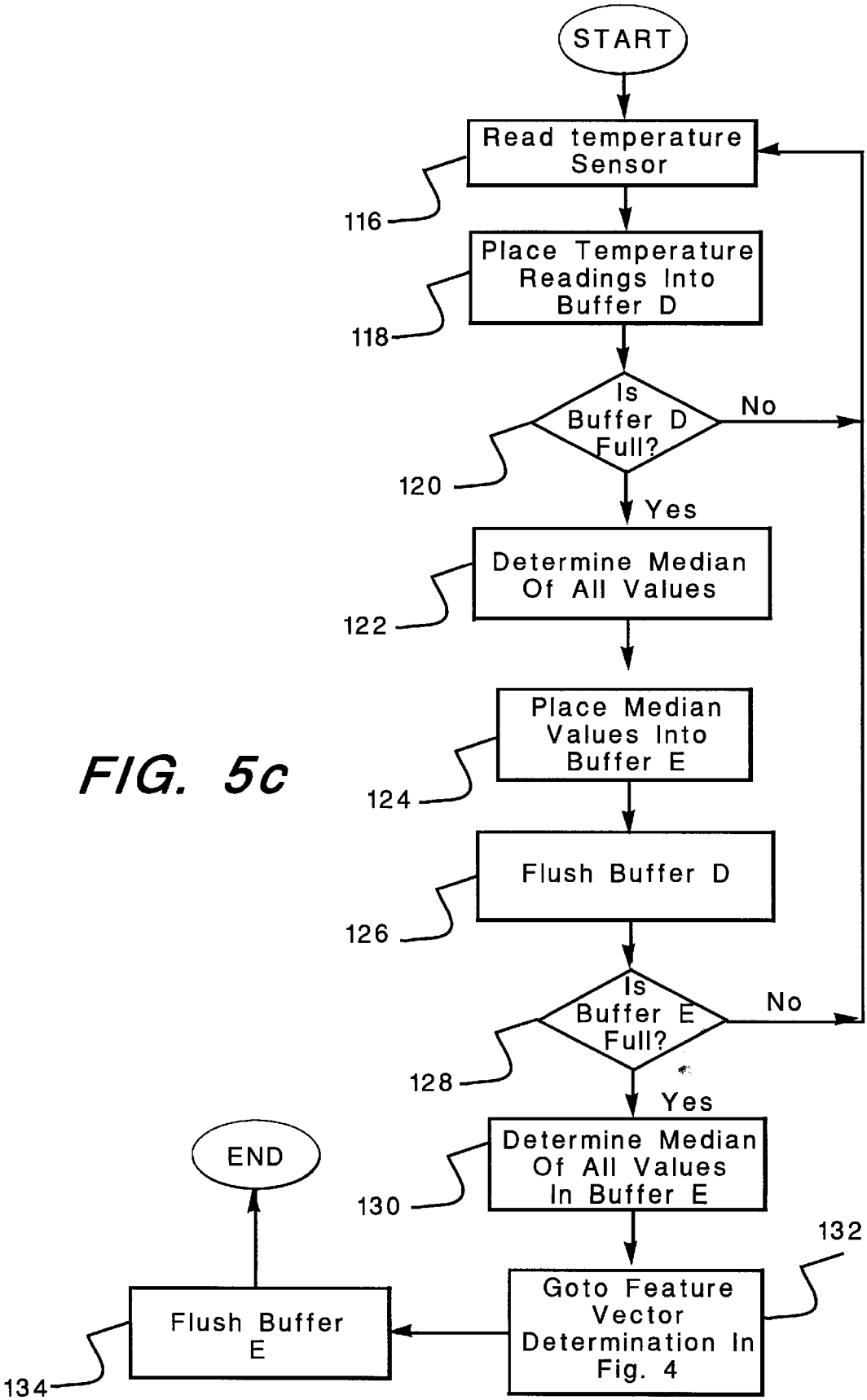
Figure 5D:
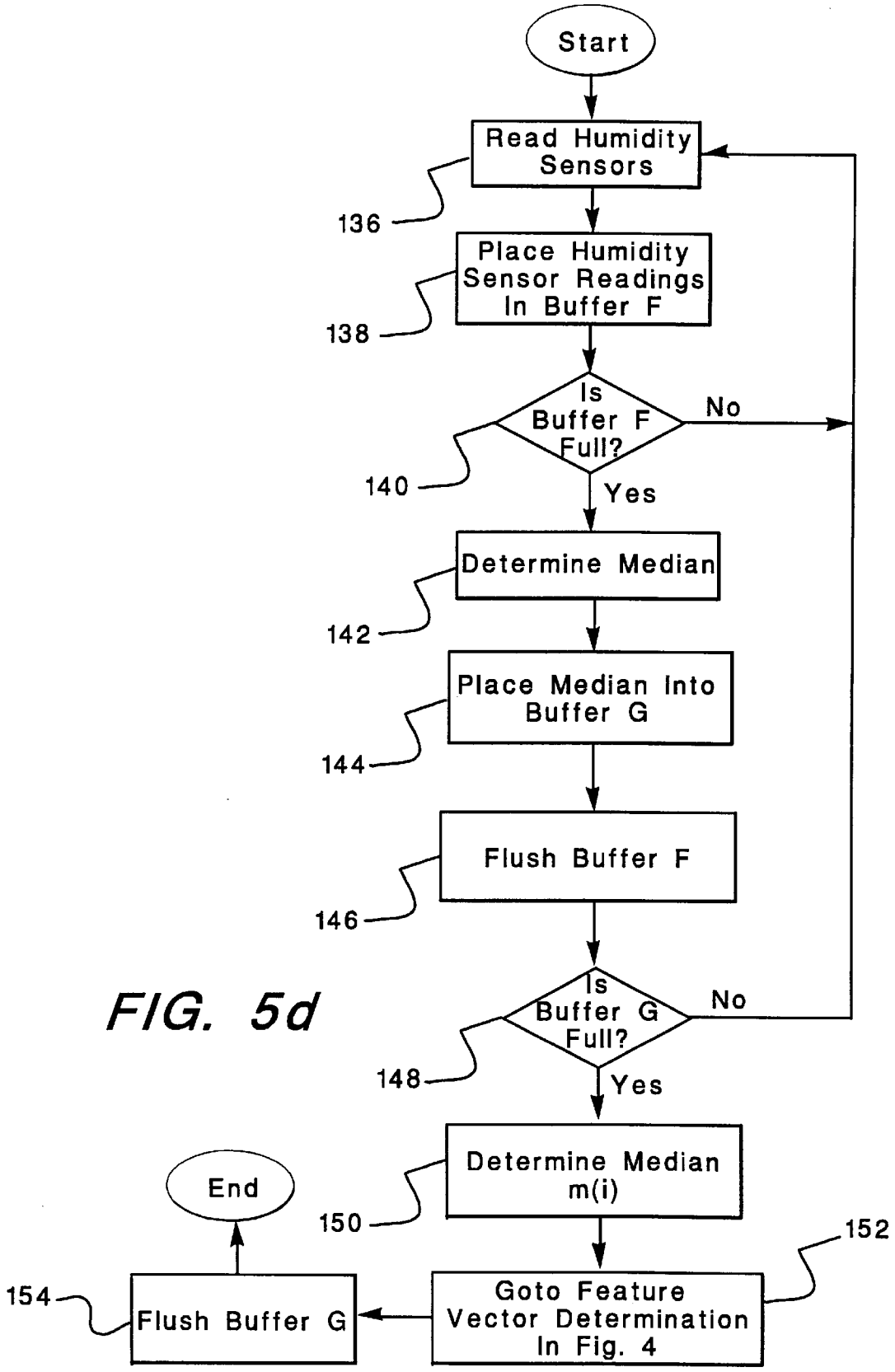

FIGS. 5*a*–5*c* disclose the signal processing steps performed on the signal representations generated from the temperature sensor 52, the phase angle sensor 54, and the humidity sensor 56. The signal processing steps disclosed in FIGS. 5*a*–5*c* are performed in parallel in real time. Referring now to FIG. 5*a*, the signal processing steps of the phase angle signal representations will be described. The signal processing begins at 86 where the phase angle sensor is read. The phase angle signal is denoted as $P_0(i)$ where i denotes its time sampling sequence. The phase angle signal $P_0(i)$ is transformed into a relative phase angle $P_n(i)$ at 88, wherein $P_n(i)$ equals $90°-P_0(i)$. The $P_n(i)$ data value is placed in Buffer A at 90. One by one the $P_n(i)$ data values are placed into Buffer A until it has been determined that the buffer is full at 92. When Buffer A is full, the range of all values stored in the buffer is calculated at 94 and placed into Buffer B at 96 and then Buffer A is flushed at 98. If Buffer B is not full at 100, then the phase angle sensor is read again and steps 86–98 are repeated until Buffer B is full. When Buffer B is full, the median of all values stored in Buffer B is calculated at 102 and placed into Buffer C at 104 and then Buffer B is flushed at 106. If Buffer C is not full at 108, then the phase angle sensor is read again and steps 88–106 are repeated until Buffer C is full. When Buffer C is full, the median of all values stored in Buffer C is calculated at 110. Once the median of all values stored in Buffer C has been calculated then the median value $P_n(i)$ is passed at 112 to the feature vector determination described below in reference to FIG. 4 and Buffer C is flushed at 114. This process is repeated until the end of the drying cycle.

As mentioned above the signal processing steps for the phase angle, temperature signal, and humidity representations are performed in parallel in real time. Referring now to FIG. 5*b*, the signal processing steps of the temperature signal representations will be described. The signal processing of the temperature begins at 116 where the temperature sensor is read. The temperature signal is denoted as T(j) where j denotes its time sampling sequence. The T(j) data value is placed in Buffer D at 118. One by one the T(j) data values are placed into Buffer D until it has been determined that the buffer is full at 120. When Buffer D is full, the median of all values stored in the buffer is calculated at 122 and placed into Buffer E at 124 and then Buffer D is flushed at 126. If Buffer E is not full at 128, then the temperature sensor is read again and steps 118–126 are repeated until Buffer E is full. When Buffer E is full, the median of all values stored in Buffer E is calculated at 130. Once the median of all values stored in Buffer E has been calculated then the median value T(j) is passed at 132 to the feature vector determination described below in reference to FIG. 4 and Buffer E is flushed at 134. This process is repeated until the end of the drying cycle.

Referring now to FIG. 5*c* the signal processing steps of the humidity signal representations will be described. The signal processing begins at 136 where the humidity sensor is read. The humidity signal is denoted as m(i) where i denotes its time sampling sequence. The m(i) data value is placed in Buffer F at 138. One by one the m(i) data values are placed into Buffer F until it has been determined that the buffer is full at 140. When Buffer F is full, the median of all values stored in the buffer is calculated at 142 and placed into Buffer G at 144 and then Buffer F is flushed at 146. If Buffer G is not full at 148, then the humidity sensor is read again and steps 138–146 are repeated until Buffer G is full. When Buffer G is full, the median of all values stored in Buffer G is calculated at 150. Once the median of all values stored in Buffer G has been calculated then the median value m(i) is passed at 152 to the feature vector determination described below in reference to FIG. 4 and Buffer G is flushed at 154. This process is repeated until the end of the drying cycle.

Referring back to FIG. 4, the data values for the phase angle, temperature, and humidity signal representations are converted to a feature vector, i.e., $[P_n(i)\ T(j)\ m(i)]$ at 156. The feature vector is then applied to the neural network stored in the ROM 70 at 158. The neural network which is described below in more detail predicts the percentage of moisture content and degree of dryness of the clothing articles according to the feature vector at 160. As mentioned above, the percentage of moisture content is divided into five categories which are classified as moist, less dry, normal, dry, and bone dry. The clothing articles are considered moist if the percentage of moisture content ranges from about 100% to about 16%. The less dry classification has a percentage of moisture content ranging from about 16% to about 10%, the normal classification has a percentage of moisture content ranging from about 10% to about 5%, the dry classification has a percentage of moisture content ranging from about 5% to about 3%, and the bone dry classification has a percentage of moisture content ranging from about 3% to about 0%. Each percentage of moisture content classification maps to a corresponding degree of dryness value. For example, in the illustrative embodiment, the moist classification is quantized as 0.00, the less dry classification is quantized as 0.25, the normal classification is quantized as 0.50, the dry classification is quantized as 0.75, and the bone dry classification is quantized as 1.00. The invention is not limited to these quantization values and may have other designated values if desired.

After the percentage of moisture content and degree of dryness have been predicted by the neural network, the values are then compared to the dryness selection made by the user at 162. If the predicted percentage of moisture content is within the dryness range selected by the user at 164, then the clothes dryer 10 is shut off at 166. Alternatively, if the predicted percentage of moisture content is not within the dryness range selected by the user, then the sensors are read again at 82 and steps 84 and 156–164 are repeated until the predicted percentage of moisture content is within the dryness range selected by the user. For example, if the user has selected a dryness selection of dry and the neural network has predicted that the percentage of moisture content remaining in the clothing articles is 13% (i.e. less dry), then drying cycle is continued until the neural network predicts that the percentage of moisture content is within the range of about 5% to about 3%. Once the percentage of moisture content is within range the controller 58 shuts the clothes dryer 10 off.

Figure 6:
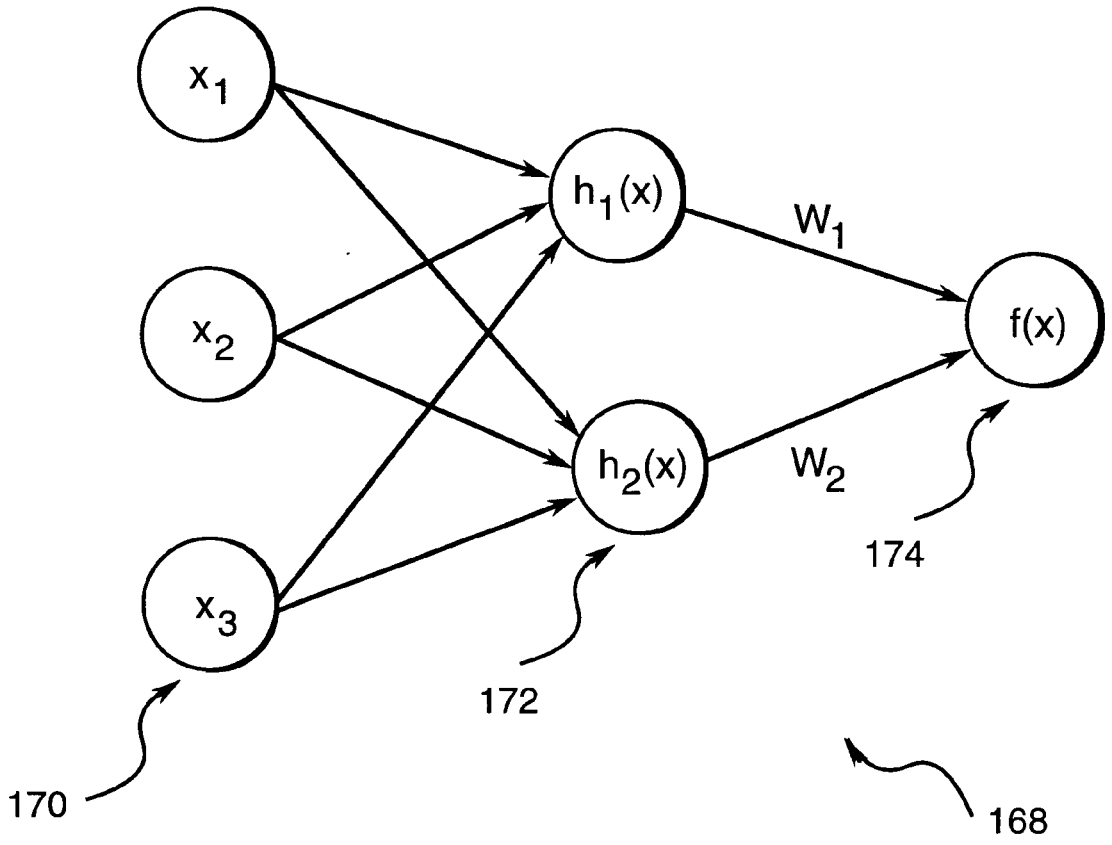
FIG. 6 shows a Radial Basis Function neural network.

In the illustrative embodiment, the neural network is preferably an n×m×1 radial basis function (RBF) neural network, where each of the n components of an input vector X feeds forward to m basis functions with their outputs being linearly combined with m weights into a network output f(x). An example of a 3×2×1 RBF neural network 168 is shown in FIG. 6. The RBF neural network 168 has three input nodes in an input layer 170, two hidden nodes in a hidden layer 172, and one output node in an output layer 174. Input variables $x_1$, $x_2$, and $x_3$ are each assigned to a node in the input layer 170 and fed forward to each node in the hidden layer 172 with weights equal to one. The hidden nodes contain RBFs $h_1(x)$ and $h_2(x)$. A RBF is a special function that has a response that decreases or increases monotonically with distance from a center position. A typical RBF is the Gaussian density function which is defined by a center position and a radius parameter. The Gaussian function gives the highest center position and decreases monotonically as the distance from the center increases. The radius controls the rate of decrease; for example, a small radius value gives a rapidly decreasing function and a large value gives a slowly decreasing function. A typical Gaussian function h(x) is defined as:

$$h(x) = \exp\left(-\frac{(x-c)^2}{r^2}\right), \tag{1}$$

wherein c is the center and r is the radius. The outputs of the RBFs $h_1(x)$ and $h_2(x)$ are linearly combined with weights $w_1$ and $w_2$ into the network output f(x).

Figure 7:
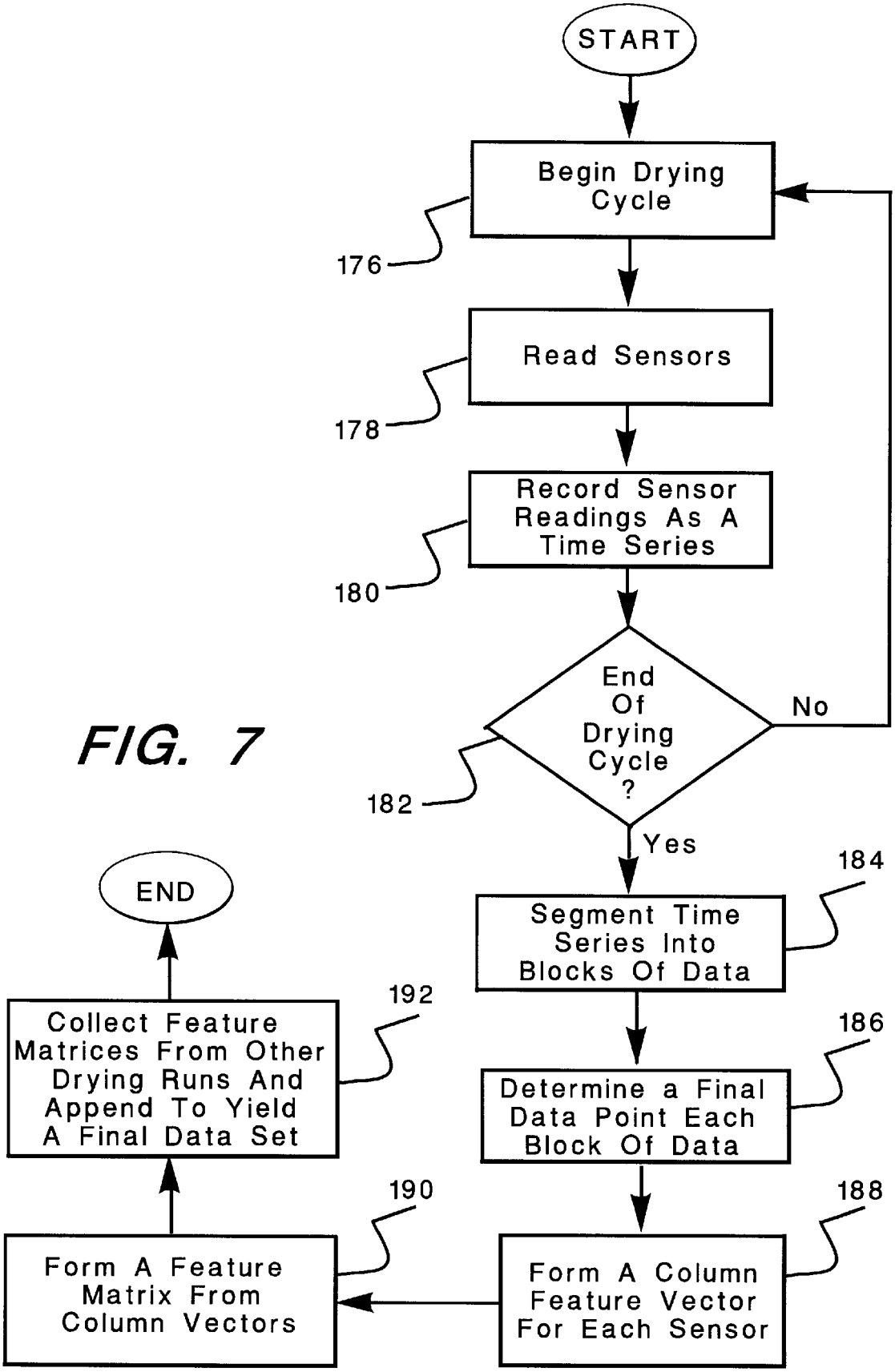
FIG. 7 shows a flow chart setting forth the data acquisition steps performed in this invention.

In order for the RBF neural network 168 to be used for predicting the percentage of moisture content and the degree of dryness of clothing articles, data from many drying runs are acquired and used to train and test the network. Many drying runs are necessary in order to account for variations in different fabrics, load size, initial moisture content, and vent restrictions. For each drying run, readings from the phase angle sensor, temperature sensor, and humidity sensor were logged into a data logger and a signal processor. In addition, a weight scale is used to sense the corresponding weight of the clothing articles at each time instance. A flow chart describing the data acquisition steps performed in this invention is set forth in FIG. 7. For each drying run, the drying cycle begins at 176. The temperature sensor, the phase angle sensor, the humidity sensor, and the weight scale are read at 178. Each sensor reading is recorded as a time series at 180. Steps 178 and 180 continue until it is determined that the end of the drying cycle has been reached at 182.

The time series of data acquired from the drying run are then segmented into blocks of data at 184 for each sensor. An example of a humidity time series plot is shown in FIG. 8. The humidity time series plot in FIG. 8 comprises data blocks ab, bc, cd, de, ef, fg, gh, hi, and ij. For each block of data, a final data point is determined at 186 by using the signal processing technique described in FIG. 5*c*. The final data point is representative of the information in the block. The final data points for the humidity sensor in FIG. 8 are represented by $h_{ab}$, $h_{bc}$, $h_{cd}$, $h_{de}$, $h_{ef}$, $h_{fg}$, $h_{gh}$, $h_{hi}$, and $h_{ij}$. The final data points are then collected and used to formulate a column vector at 188 for each sensor. The column vector of final data points for the humidity sensor in FIG. 8 is represented by [$h_{ab}$, $h_{bc}$, $h_{cd}$, $h_{de}$, $h_{ef}$, $h_{fg}$, $h_{gh}$, $h_{hi}$, and $h_{ij}$]. Note that the phase angle time series and the temperature time series are processed according to the signal processing techniques described in FIGS. 5*a* and 5*b*, respectively, to derive the final data points used for their respective column vectors.

Each column vector from the temperature sensor, the phase angle sensor, the humidity sensor, and the weight scale are collected and used to formulate a feature matrix at 190. An example of a feature matrix is shown in FIG. 9. The feature matrix in FIG. 9 comprises seven column vectors. Four of the column vectors are from the temperature sensor, the phase angle sensor, the humidity sensor, and the weight scale. The column vector for the temperature sensor is represented by [$T_{ab}$, $T_{bc}$, $T_{cd}$, $T_{de}$, $T_{ef}$, $T_{fg}$, $T_{gh}$, $T_{hi}$, and $T_{ij}$]. The column vector for the phase angle sensor is represented by [$p_{ab}$, $p_{bc}$, $p_{cd}$, $p_{de}$, $p_{ef}$, $p_{fg}$, $p_{gh}$, $p_{hi}$, and $p_{ij}$]. The column vector for the humidity sensor is represented by [$h_{ab}$, $h_{bc}$, $h_{cd}$, $h_{de}$, $h_{ef}$, $h_{fg}$, $h_{gh}$, $h_{hi}$, and $h_{ij}$]. The column vector for the weight scale is represented by [$w_{ab}$, $w_{bc}$, $w_{cd}$, $w_{de}$, $w_{ef}$, $w_{fg}$, $w_{gh}$, $w_{hi}$, and $w_{ij}$]. The other column vectors are the time step of the segmented blocks of data, the percentage of moisture content, and the degree of dryness. The time step column vector is represented by [$t_{ab}$, $t_{bc}$, $t_{cd}$, $t_{de}$, $t_{ef}$, $t_{fg}$, $t_{gh}$, $t_{hi}$, and $t_{ij}$]. The percentage of moisture content and the degree of dryness vectors are determined from the temperature, the phase angle, the humidity, and the weight column vectors. The percentage of moisture content vector is represented by [$\%MC_{ab}$, $\%MC_{bc}$, $\%MC_{cd}$, $\%MC_{de}$, $\%MC_{ef}$, $\%MC_{fg}$, $\%MC_{gh}$, $\%MC_{hi}$, and $\%MC_{ij}$]. The degree of dryness vector is represented by [$DoD_{ab}$, $DoD_{bc}$, $DoD_{cd}$, $DoD_{de}$, $DoD_{ef}$, $DoD_{fg}$, $DoD_{gh}$, $DoD_{hi}$, and $DoD_{ij}$]. Steps 178 through 190 are repeated for each drying run. Finally, all the feature matrices from each individual drying run are collected at 192 and appended together in a matrix to yield a final data set.

Figure 10:
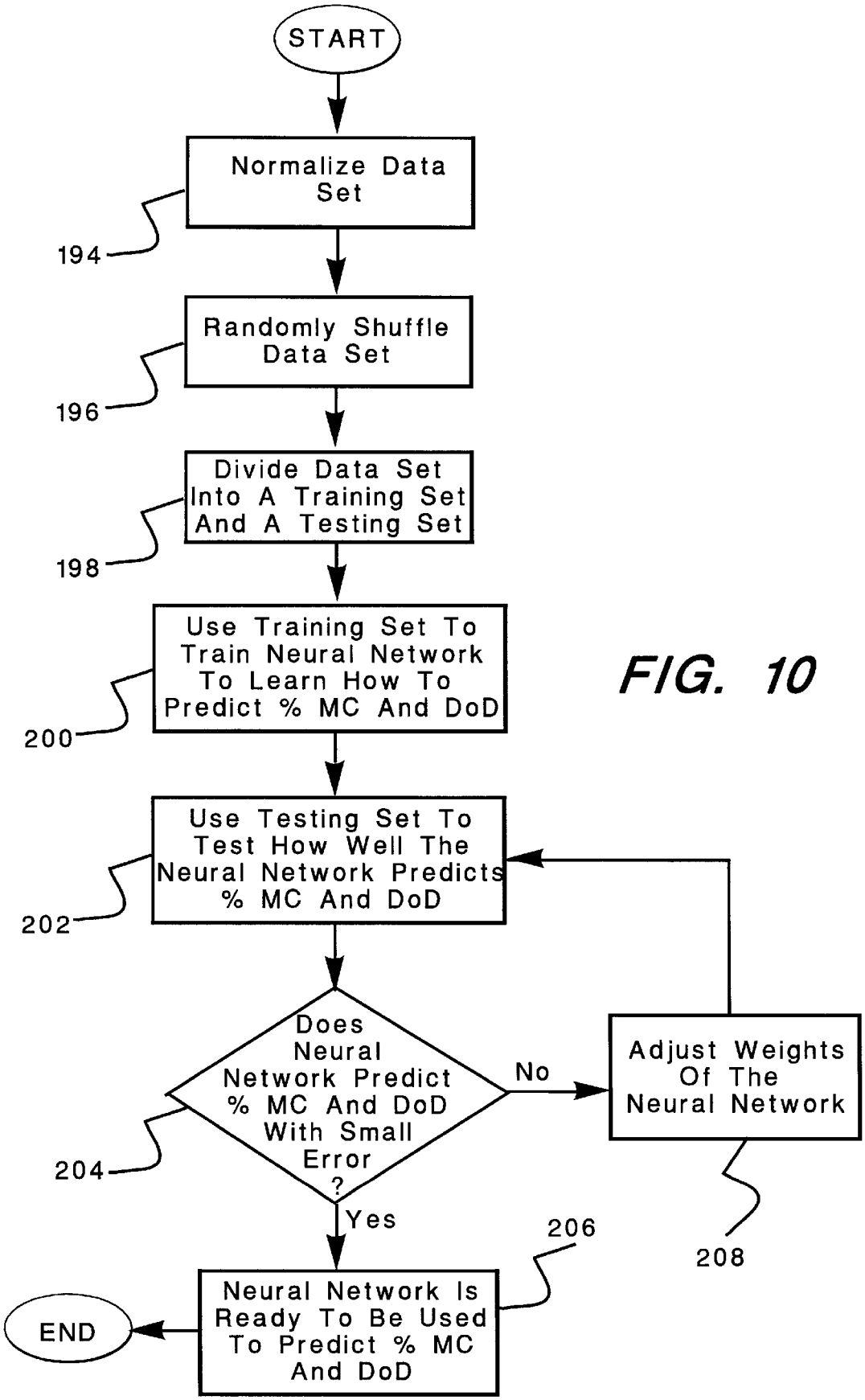
FIG. 10 shows a flow chart setting forth the training and testing steps performed in this invention.

In order for the neural network to be used for predicting the percentage of moisture content and degree of dryness, it has to be trained and tested with the final data set. A flow chart describing the training and testing steps performed in this invention is set forth in FIG. 10. Before training and testing, the final data set is formatted and preprocessed. A typical final data set from as many as 94 drying runs can have about 1475 patterns. Each pattern comprises of six fields; the time step that the sensor readings were processed, the clothes temperature, the phase angle, the relative humidity, the percentage of moisture content, and the degree of dryness. In each pattern, the first four fields are inputs and the last two fields are the predicted variables. The equation for calculating the percentage of moisture content, %MC, is as follows:

$$\%\,MC = \frac{\text{weight} - \text{bone dry weight}}{\text{bone dry weight}} \times 100\%, \tag{2}$$

wherein the bone dry weight is measured before water is applied to the washing load. The degree of dryness is determined by using the aforementioned quantization method for the percentage of moisture content. The preprocessing begins first by normalizing the data set at 194 to avoid saturation of the nodes on the RBF neural network input layer. The equation for normalization is as follows:

$$\text{Normalized Value} = \frac{\text{nominal value} - \text{minimum value}}{\text{maximum value} - \text{minimum value}}, \tag{3}$$

where the minimum and maximum values are obtained across one specific field. Next, the data set is randomly shuffled across all patterns at 196 so that the RBF neural network can learn the underlying mapping of drying states obtained from sensor readings to drying quality and the percentage of moisture content; and not the sequence of how the final data set was presented to it.

The data set is then divided into two parts, a training set and a testing set at 198. A data set with about 1475 patterns can be divided in a training set of about 745 patterns and a testing set of about 730 patterns. The training set is used to train the RBF neural network to learn how to predict the percentage of moisture content, %MC, and the degree of dryness, DoD; that is essentially computing the value of the weight coefficients by using a Least Squares optimization type of method. The testing set is used to test the prediction performance of the RBF neural network when presented with a new data set. If the training is successful, then the RBF neural network is expected to do reasonably well for the data that it has never seen before. This property is often labeled as "generalization". At 200, the training set is used to train the RBF neural network to learn how to predict the percentage of moisture content and the degree of dryness. In the illustrative embodiment, the RBF neural network is trained by adjusting its weight vector using Least Squares learning. For a training set with p patterns, $[(x_i, y_i)]_{=1}$, the optimal weight vector can be found by minimizing the sum of squared errors as follows:

$$\sum_{i=1}^{p} (y_i - f(x_i))^2, \tag{4}$$

wherein $f(x_i)$ is the output of the RBF neural network. In addition, the sum of squared errors is augmented with a bias term which penalizes large weights with the following:

$$C = \sum_{i=1}^{p} (y_i - f(x_i))^2 + \sum_{j=1}^{m} \lambda_j \omega_j^2, \quad (5)$$

wherein C is the cost function to be minimized and m is the number of hidden nodes in the neural network. This is called local ridge regression or weight decay. Essentially, the bias $\lambda_j$ introduced favors solutions involving small weights and the effect is to smooth the output function since large weights are usually required to produce a highly variable (rough) output function. Despite the fact that a linear network with fixed position and size is used in this embodiment, the flexibility of a non-linear neural network is gained by going through a process of selecting a subset of basis functions from a larger set of candidates. This is called subset selection in statistics. It is usually intractable to find the best subset; there are $2^m-1$ subsets in a set of size m. Hence heuristics are then used in the search procedures. One of the heuristics is called forward selection. It starts with an empty subset and one basis function is added one at a time. The one subset which reduces the sum of squares errors the most is the best. The process stops adding basis functions once some chosen criterion stops decreasing the $R^2$ a performance index, which is described below in more detail, in the validation data set.

Performance indexes can be used to measure how well the RBF neural network was trained. Three performance indices that may be used are the mean squared error (MSE), the average percentage error (APE), and the R squares ($R^2$). The mean squared error is defined as:

$$MSE = \frac{1}{p} \times \sum_{i=1}^{p} (T_i - O_i)^2, \quad (6)$$

where p is the number of patterns in training and testing and $T_i$ and $O_i$ are the ith targeted output and calculated output, respectively. The smaller the MSE, the closer the calculated output is to the targeted output. The APE is defined as:

$$APE = \frac{1}{p} \times \sum_{i=1}^{p} \frac{|T_i - O_i|}{|T_i|} \times 100\%, \quad (7)$$

The APE reveals on the average how far the calculated output is from the targeted output in percentage. The $R^2$ performance indices is defined as:

$$R^2 = 1.0 - \left( \frac{\sum_{i=1}^{p} (T_i - O_i)^2}{\sum_{i=1}^{p} (T_i - \overline{T})^2} \right), \quad (8)$$

wherein $\overline{T}$ is the mean of targeted outputs. The $R^2$ removes the effects of target variance and yields an error value usually between 0 and 1. The closer the $R^2$ value is towards 1, the better the performance. In particular, $R^2$ is particular useful for back-propagation type neural networks, since a back-propagation network learns relatively easily the pattern represented by the average target values of the output nodes. This is a sort of a "worst case" scenario in which the neural network is "guessing" the correct output to be the average target value, and results in a value of $R^2$ of 0. As the patterns are learned, the value of $R^2$ moves toward 1.

Referring back to FIG. 10, after the RBF neural network is trained, the testing set of data is then used to test how well the trained RBF network predicts the percentage of moisture content and the degree of dryness at 202. The testing is measured by using the aforementioned performance indices. If the trained RBF neural network does predict the percentage of moisture content and degree of dryness with small error (e.g. $10^{-4}$) at 204, then the RBF network is ready to be used at 206 to predict the percentage of moisture content and degree of dryness in the manner described in FIG. 4. However, if the trained RBF neural network is unable to predict the percentage of moisture content and degree of dryness with small error at 204, then the weights are adjusted at 208 and steps 202–204 are repeated until the error becomes small enough.

Although the illustrative embodiment has been described with reference to a RBF neural network, it is within the scope of the present invention to use other types of neural networks such as a multi-layer perceptron and other supervised learning neural networks. An example of another type of neural network that may be used is a stepwise RBF neural network. A stepwise RBF neural network is used to economize on computational efforts, as compared with the all-possible-regressions approach, while arriving at the "best" subset of independent variables. Essentially, it first builds a RBF model involving all independent variables, then it develops a sequence of RBF models. At each step, an independent variable is deleted. Thus, there would be $$\sum_{i=1}^{10} i = 55$$

possible RBF models when there are ten independent variables in the pool. The criterion for deleting an independent variable is stated equivalently in terms of $R^2$ reduction. In other words, an independent variable would be dropped out if it yields the lowest $R^2$ averaged over while training and testing data at each iterative step. For instance, assume that there are three independent variables in the pool, $x_1$, $x_2$, and $x_3$. Suppose $x_1$, $x_2$, and $x_3$ yields an averaged $R^2$ which equals 0.5, 0.6, and 0.7, respectively. As a result $x_1$ would be dropped out.

An example of how a stepwise RBF neural network is used to predict the percentage of moisture content and degree of dryness is now described. In this embodiment, the stepwise RBF neural network uses four input nodes and one output node; the four inputs are time step, phase angle, temperature, and humidity. The input nodes are labeled as variables 1, 2, 3, and 4, respectively, and the output node is labeled as percentage of moisture content. Forward selection and local ridge schemes are again used to train the RBF. The results of using a stepwise RBF neural network in this embodiment are shown below in Table 1.

TABLE 1

| nth variable | Training MSE | R2 | Testing MSE | R2 |
|---|---|---|---|---|
| 0 | 0.0044 | 0.92 | 0.0064 | 0.87 |
| 3 | 0.0052 | 0.9 | 0.0071 | 0.86 |
| 2 | 0.0069 | 0.87 | 0.0095 | 0.81 |
| 4 | 0.0269 | 0.48 | 0.0266 | 0.48 |

Each row of Table 1 represents the result after each stepwise iteration. The first row represents the initial training where all of the four variables remain in the RBF model. It results in a four-input RBF neural network whose $R^2$ are 0.92 and 0.87 for training and testing, respectively. The second iteration drops out variable 3, temperature, and results in a three-input RBF neural network with an $R^2$ of 0.90 and 0.86 for training and testing, respectively. Similarly, the third iteration further drops out variable 2, phase angle, and results in a two-input RBF neural with an $R^2$ of 0.87 and 0.81 for training and testing, respectively. Note that the number of stepwise iterations is equivalent to the number of RBF inputs. The stepwise procedure starts with a RBF with all the inputs and ends with a RBF with only one input. Each iteration results in an optimal RBF in the minimal $R^2$ sense for a class of a RBF with fixed number of inputs. This variable dropping out process for this embodiment is summarized in Table 2.

TABLE 2

| Iteration | RBF Inputs | | | | RBF Outputs |
|---|---|---|---|---|---|
| 1 | time-step | phase angle | temp | humidity | % MC |
| 2 | time-step | phase angle | | humidity | % MC |
| 3 | time-step | | | humidity | % MC |
| 4 | time-step | | | | % MC |

The stepwise RBF neural network enables the percentage of moisture content and degree of dryness to be accurately predicted with an optimized number of sensors selected from a group comprising a phase angle sensor, a temperature sensor, or a humidity sensor.

Therefore, it is not necessary that the clothes dryer 10 be implemented with the phase angle sensor, the temperature sensor, and the humidity sensor. In particular, the clothes dryer may be implemented with a combination of sensors selected from the group comprising a phase angle sensor, a temperature sensor, and a humidity sensor, in order to predict the percentage of moisture content and degree of dryness. For example, the clothes dryer may be implemented with only the phase angle sensor and the humidity sensor, or just the humidity sensor. Other combinations of sensors are within the scope of this invention if desired. Depending on the combination of sensors selected, the prediction of the percentage of moisture content and the degree of dryness can be performed in the manner described in FIG. 4 and FIGS. 5*a*–5*c*. For example, if the clothes dryer is implemented with a phase angle sensor and a humidity sensor, then the percentage of moisture content and degree of dryness are predicted in accordance with FIG. 4 and FIGS. 5*a* and 5*c*.

It is therefore apparent that there has been provided in accordance with the present invention, a system and method for predicting the dryness of articles in an appliance that fully satisfy the aims and advantages and objectives hereinbefore set forth. The invention has been described with reference to several embodiments, however, it will be appreciated that variations and modifications can be effected by a person of ordinary skill in the art without departing from the scope of the invention.

We claim:

1. An appliance for drying clothing articles, comprising:

a container for receiving the clothing articles;

a motor for rotating the container about an axis;

a heater for supplying heated air to the container;

a duct for directing the heated air outside the container;

a combination of sensors selected from a group comprising a temperature sensor for sensing the heated air and providing signal representations thereof, a phase angle sensor for sensing motor phase angle and providing signal representations thereof, or a humidity sensor for sensing the humidity of the heated air entering the duct and providing signal representations thereof; and a controller responsive to the combination of selected sensors for predicting a percentage of moisture content and a degree of dryness of the clothing articles in the container.

2. The appliance according to claim 1, wherein the controller comprises a signal processing unit for processing the signal representations from the combination of selected sensors into a feature vector.

3. The appliance according to claim 2, wherein the controller comprises a neural network for predicting the percentage of moisture content and degree of dryness of the clothing articles in the container as a function of the feature vector.

4. The appliance according to claim 3, wherein the neural network is a stepwise radial basis neural network.

5. The appliance according to claim 3, further comprising a cycle selector for selecting a desired dryness for the clothing articles.

6. The appliance according to claim 5, wherein the controller comprises a disable unit for disabling the drying cycle of the appliance when the predicted percentage of moisture content and degree of dryness are within range of the desired dryness.

7. The appliance according to claim 1, wherein the percentage of moisture content is classified into a plurality of arbitrary selected intervals each having a degree of dryness classification.

8. The appliance according to claim 7, wherein the plurality of arbitrary selected intervals range from about 0% to about 3% moisture content, from about 3% to about 5% moisture content, from about 5% to about 10% moisture content, from about 10% to about 16% moisture content, and from about 16% to about 100% moisture content.

9. The appliance according to claim 8, wherein the interval ranging from about 0% to about 3% moisture content has a degree of dryness classified as bone dry, the interval ranging from about 3% to about 5% moisture content has a degree of dryness classified as dry, the interval ranging from about 5% to about 10% moisture content has a degree of dryness classified as normal, the interval ranging from about 10% to about 16% moisture content has a degree of dryness classified as less dry, and the interval ranging from about 16% to about 100% moisture content has a degree of dryness classified as moist.

10. An appliance for drying clothing articles, comprising:

a container for receiving the clothing articles;

a motor for rotating the container about an axis;

a heater for supplying heated air to the container;

a duct for directing the heated air outside the container;

at least one sensor comprising a phase angle sensor for sensing motor phase angle and providing signal representations thereof, and at least one of a temperature sensor for sensing the heated air and providing signal representations thereof, and a humidity sensor for sensing the humidity of the heated air entering the duct and providing signal representations thereof and combinations thereof; and a controller responsive to the sensors for predicting a percentage of moisture content and a degree of dryness of the clothing articles in the container.

11. The appliance according to claim 10, wherein the controller comprises a signal processing unit for processing the signal representations from the sensors into a feature vector.

12. The appliance according to claim 11, wherein the controller comprises a neural network for predicting the percentage of moisture content and degree of dryness of the clothing articles in the container as a function of the feature vector.

13. The appliance according to claim 12, wherein the neural network is a stepwise radial basis neural network.

14. The appliance according to claim 12, further comprising a cycle selector for selecting a desired dryness for the clothing articles.

15. The appliance according to claim 14, wherein the controller comprises a disable unit for disabling the drying cycle of the appliance when the predicted percentage of moisture content and degree of dryness are within range of the desired dryness.

16. The appliance according to claim 10, wherein the percentage of moisture content is classified into a plurality of arbitrary selected intervals each having a degree of dryness classification.

17. The appliance according to claim 16, wherein the plurality of arbitrary selected intervals range from about 0% to about 3% moisture content, from about 3% to about 5% moisture content, from about 5% to about 10% moisture content, from about 10% to about 16% moisture content, and from about 16% to about 100% moisture content.

18. The appliance according to claim 17, wherein the interval ranging from about 0% to about 3% moisture content has a degree of dryness classified as bone dry, the interval ranging from about 3% to about 5% moisture content has a degree of dryness classified as dry, the interval ranging from about 5% to about 10% moisture content has a degree of dryness classified as normal, the interval ranging from about 10% to about 16% moisture content has a degree of dryness classified as less dry, and the interval ranging from about 16% to about 100% moisture content has a degree of dryness classified as moist.

* * * * *